US010208745B2

(12) United States Patent
Abrol et al.

(10) Patent No.: US 10,208,745 B2
(45) Date of Patent: Feb. 19, 2019

(54) SYSTEM AND METHOD FOR CONTROLLING A FLUID TRANSPORT SYSTEM

(71) Applicant: General Electric Company, Schenectady, NY (US)

(72) Inventors: Sidharth Abrol, Karnataka (IN); Rosa Castane Selga, Bavaria (DE); Guillaume Becquin, Bavaria (DE); Axel Busboom, Bavaria (DE); Rogier Sebastiaan Blom, Ballston Lake, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 264 days.

(21) Appl. No.: 14/973,940

(22) Filed: Dec. 18, 2015

(65) Prior Publication Data

US 2017/0175731 A1 Jun. 22, 2017

(51) Int. Cl.
*F04B 49/20* (2006.01)
*E21B 43/12* (2006.01)
(Continued)

(52) U.S. Cl.
CPC ..... *F04B 49/20* (2013.01); *E21B 43/01* (2013.01); *E21B 43/121* (2013.01); *E21B 43/36* (2013.01);
(Continued)

(58) Field of Classification Search
CPC ..... F04B 49/20; F04B 13/02; F04B 19/06; F04B 47/06; F04B 49/06; F04B 49/065;
(Continued)

(56) References Cited

U.S. PATENT DOCUMENTS 5,288,312 A 2/1994 Payne et al.
5,375,618 A 12/1994 Giannesini
(Continued)

FOREIGN PATENT DOCUMENTS

AU 631445 B2 11/1992
AU 631455 B2 12/1992
(Continued)

OTHER PUBLICATIONS

Jahanshahi, E. et al., "Subsea Solution for Anti-Slug Control of Multiphase Risers," 2013 European Control Conference (ECC), Jul. 17-19, 2013, Zurich, Switzerland, pp. 4094-4099.
(Continued)

*Primary Examiner* — Dominick L Plakkoottam
*Assistant Examiner* — Connor J Tremarche
(74) *Attorney, Agent, or Firm* — GE Global Patent Operation; Marc A. Vivenzio

(57) ABSTRACT

A fluid transport system includes at least one flow control device and a multiphase pump configured to transport fluid. At least one pump sensing device is configured to measure at least one operating characteristic of the multiphase pump. A controller is programmed with a pump map including a correlation of the at least one operating characteristic of the multiphase pump with at least one operating characteristic of the fluid. The controller is configured to determine an estimated value of the at least one operating characteristic of the fluid based on the measured value of the at least one operating characteristic of the multiphase pump and the pump map. At least one regulating device coupled to at least one flow control device is modulated based on the estimated value of the at least one operating characteristic of the fluid.

15 Claims, 8 Drawing Sheets

(51) Int. Cl.

| | |
|---|---|
| ***F04B 49/22*** | (2006.01) |
| ***F04B 47/06*** | (2006.01) |
| ***F04B 19/06*** | (2006.01) |
| ***F04B 13/02*** | (2006.01) |
| ***F04D 13/08*** | (2006.01) |
| ***F04D 15/00*** | (2006.01) |
| ***F04B 49/06*** | (2006.01) |
| ***F04D 31/00*** | (2006.01) |
| ***F04B 49/08*** | (2006.01) |
| ***F04C 14/24*** | (2006.01) |
| ***E21B 43/01*** | (2006.01) |
| ***E21B 43/36*** | (2006.01) |

(52) U.S. Cl.

CPC ..... *F04B 13/02* (2013.01); *F04B 19/06* (2013.01); *F04B 47/06* (2013.01); *F04B 49/06* (2013.01); *F04B 49/065* (2013.01); *F04B 49/08* (2013.01); *F04B 49/22* (2013.01); *F04C 14/24* (2013.01); *F04D 13/086* (2013.01); *F04D 15/0088* (2013.01); *F04D 31/00* (2013.01); *F04B 2203/0208* (2013.01); *F04B 2205/07* (2013.01); *F04B 2205/503* (2013.01); *F04C 2210/24* (2013.01); *F04C 2240/81* (2013.01); *F04C 2270/60* (2013.01); *F05D 2260/821* (2013.01); *F05D 2270/304* (2013.01); *F05D 2270/3015* (2013.01); *F05D 2270/335* (2013.01)

(58) Field of Classification Search

CPC ..... F04B 49/08; F04B 49/22; F04D 13/086; F04D 15/0088; F04D 31/00; F04C 14/24; E21B 43/00; E21B 43/121

USPC ..... 417/282

See application file for complete search history.

(56) References Cited

U.S. PATENT DOCUMENTS

| | | | | |
|---|---|---|---|---|
| 5,377,714 | A | 1/1995 | Giannesini et al. | |
| 5,393,202 | A * | 2/1995 | Levallois | E21B 43/12 417/19 |
| 5,544,672 | A | 8/1996 | Payne et al. | |
| 5,711,338 | A | 1/1998 | Talon | |
| 5,775,879 | A * | 7/1998 | Durando | E21B 43/121 417/44.2 |
| 5,841,020 | A * | 11/1998 | Guelich | G01F 1/363 73/19.12 |
| 6,007,306 | A | 12/1999 | Vilagines | |
| 6,773,235 | B2 | 8/2004 | Poorte et al. | |
| 7,434,621 | B2 | 10/2008 | Aarvik et al. | |
| 7,481,270 | B2 * | 1/2009 | Shepler | E21B 17/01 137/565.3 |
| 7,668,694 | B2 * | 2/2010 | Anderson | E21B 47/042 700/281 |
| 8,489,244 | B2 | 7/2013 | Cao et al. | |
| 2004/0144182 | A1 * | 7/2004 | Gysling | G01N 33/343 73/861.42 |
| 2007/0274842 | A1 * | 11/2007 | Campen | E21B 43/36 417/53 |
| 2009/0149969 | A1 | 6/2009 | Slupphaug et al. | |
| 2010/0011875 | A1 | 1/2010 | Vyas et al. | |
| 2010/0098525 | A1 | 4/2010 | Guelich | |
| 2010/0126339 | A1 * | 5/2010 | Kobata | E02F 9/2203 91/444 |
| 2011/0259596 | A1 | 10/2011 | Daigle | |
| 2012/0235618 | A1 * | 9/2012 | Mori | H02P 29/0016 318/437 |
| 2013/0129477 | A1 * | 5/2013 | Winkes | F04D 27/0207 415/1 |
| 2014/0275690 | A1 * | 9/2014 | Hernandez | B01D 17/0217 585/800 |
| 2015/0017024 | A1 | 1/2015 | Barrios et al. | |

FOREIGN PATENT DOCUMENTS

| | | | |
|---|---|---|---|
| EP | 2325494 | A1 | 5/2011 |
| EP | 2384388 | A1 | 11/2011 |
| WO | 9724596 | A1 | 7/1997 |
| WO | 2010077932 | A1 | 7/2010 |
| WO | 2014006371 | A2 | 1/2014 |
| WO | 2016077674 | A1 | 5/2016 |

OTHER PUBLICATIONS

Pedersen, S. et al., "Experimental Study of Stable Surfaces for Anti-Slug Control in Multi-phase Flow," Proceedings of the 20th International Conference on Automation & Computing, Cranfield University, Bedfordshire, UK, Sep. 12-13, 2014 (6 pgs.).

International Search Report and Written Opinion issued in connection with corresponding PCT Application No. PCT/US2016/067082 dated Mar. 30, 2017.

* cited by examiner

SYSTEM AND METHOD FOR CONTROLLING A FLUID TRANSPORT SYSTEM

BACKGROUND

The field of the disclosure relates generally to fluid transport systems and, more particularly, to systems and methods for controlling a fluid transport system.

As oil and gas fields in shallow waters diminish, producers are tapping offshore fields in deeper waters with oil installations that operate far below the surface of the sea. The typical production equipment for such subsea oil recovery and production include a wellhead valve, slug catcher, multiphase pump, separator, recirculation valve, and topside choke valve. A portion of this equipment is located in a subsea boosting station which pumps the oil up a pipeline riser to the topside choke valve. The output of an offshore field, received at the wellhead of the subsea boosting station, typically includes a combination of hydrocarbon oil, hydrocarbon gas, and water. This mixed flow, pumped by the multiphase pump, may cause flow instabilities, such as slugging. Slugging occurs when gas separates from a mixed flow to form bubbles. In a severe slugging flow pattern, large hydrocarbon gas bubbles will accumulate. Once the hydrocarbon gas bubbles accumulate with a pressure that exceeds the liquid hydrostatic head across the pipeline riser, the hydrocarbon bubbles will travel from the field and into the subsea boosting station as a slug. These slugs, which have a gas volume fraction exceeding the operating characteristics of the multiphase pump, may contribute to a reduction in the service life of the multiphase pump if allowed to reach the multiphase pump.

The subsea station may include passive protection equipment which facilitates protecting the multiphase pump from a reduction in service life due to slug flow. Passive equipment may include one or more slug catchers. Typically, a slug catcher is a vessel including a buffer volume to store slugs travelling through the fluid transport system. The subsea station may also include active protection equipment to mitigate slug flow and multiphase pump surge. Pump surge occurs when the velocity of the multiphase fluid changes rapidly or becomes unsteady. The active equipment may also control a gas volume fraction at the inlet of the multiphase pump. Passive equipment may be inadequate to fully protect the multiphase pump or be cost prohibitive to install, and active equipment typically requires a plurality of sensors included in the production equipment of the subsea station. These sensors are typically difficult to position and may experience a reduction in service life due to the subsea environment in which they are located. It is therefore necessary to avoid the use of sensors while providing for control of active protection equipment to mitigate slug flow and multiphase pump surge.

BRIEF DESCRIPTION

In one aspect, a fluid transport system is provided. The system includes at least one flow control device and a multiphase pump configured to transport fluid. At least one pump sensing device is configured to measure at least one operating characteristic of the multiphase pump. At least one regulating device is coupled to the at least one flow control device. The system further includes a controller coupled to the at least one pump sensing device and the at least one regulating device. The controller is programmed with a pump map including a correlation of the at least one operating characteristic of the multiphase pump with at least one operating characteristic of the fluid. The controller is configured to receive from the at least one pump sensing device the measured value of the at least one operating characteristic of the multiphase pump. The controller is further configured to determine an estimated value of the at least one operating characteristic of the fluid based on the received value of the at least one operating characteristic of the multiphase pump and the pump map. The at least one regulating device is modulated based on the estimated value of the at least one operating characteristic of the fluid.

In another aspect, a method for controlling a fluid transport system and flow of a fluid implemented using a controller in communication with a memory and a multiphase pump configured to transport the fluid is provided. The method includes storing, within the memory, a pump map including a correlation of at least one operating characteristic of the multiphase pump with at least one operating characteristic of the fluid. A measured value of the at least one operating characteristic of the multiphase pump is received from at least one pump sensing device in communication with the multiphase pump and the controller. The controller determines an estimated value of the at least one operating characteristic of the fluid based on the received value of the at least one operating characteristic of the multiphase pump and the pump map. The controller modulates at least one regulating device coupled to at least one flow control device based on the estimated value of the at least one operating characteristic of the fluid.

In yet another aspect, a submersible resource recovery system for controlling a fluid transport system and flow of a fluid transported by a multiphase pump is provided. The submersible resource recovery system includes at least one flow control device and a multiphase pump configured to transport the fluid from a submerged wellhead to a non-submerged topside production location. The multiphase pump is further configured to be submersible. At least one pump sensing device is configured to measure a value of at least one operating characteristic of the multiphase pump. At least one regulating device is coupled to the at least one flow control device. A controller is coupled to the at least one pump sensing device and the at least one regulating device. The controller is programmed with a pump map including a correlation of the at least one operating characteristic of said multiphase pump with at least one operating characteristic of the fluid. The controller is configured to receive from said at least one pump sensing device the measured value of the at least one operating characteristic of said multiphase pump and determine an estimated value of the at least one operating characteristic of the fluid based on the received value of the at least one operating characteristic of said multiphase pump and said pump map. The controller is further configured to modulate the at least one regulating device based on the estimated value of the at least one operating characteristic of the fluid.

DRAWINGS

These and other features, aspects, and advantages of the present disclosure will become better understood when the following detailed description is read with reference to the accompanying drawings in which like characters represent like parts throughout the drawings, wherein.

Figure 1:
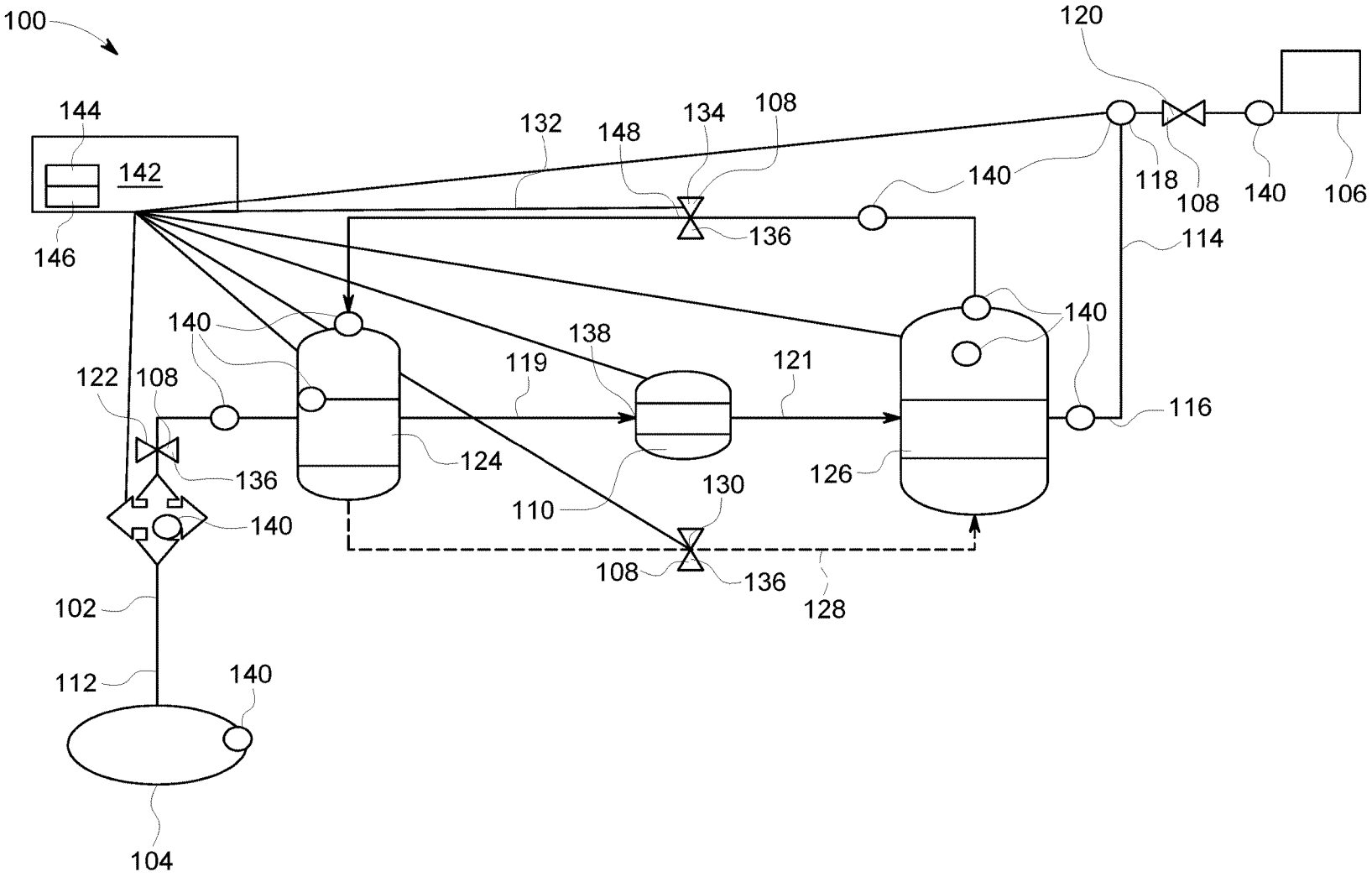
FIG. 1 is a schematic view of an exemplary fluid transport system configured to pump a multiphase flow from an oilfield to a topside production facility.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "processor" and "computer," and related terms, e.g., "processing device," "computing device," and "controller" are not limited to just those integrated circuits referred to in the art as a computer, but broadly refers to a microcontroller, a microcomputer, a programmable logic controller (PLC), and application specific integrated circuit, and other programmable circuits, and these terms are used interchangeably herein. In the embodiments described herein, memory may include, but it not limited to, a computer-readable medium, such as a random access memory (RAM), a computer-readable non-volatile medium, such as a flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program storage in memory for execution by personal computers, workstations, clients, and servers.

As used herein, the term "non-transitory computer-readable media" is intended to be representative of any tangible computer-based device implemented in any method of technology for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including without limitation, volatile and non-volatile media, and removable and non-removable media such as firmware, physical and virtual storage, CD-ROMS, DVDs, and any other digital source such as a network or the Internet, as well as yet to be developed digital means, with the sole exception being transitory, propagating signal.

The fluid transport systems described herein include a controller to control flow control devices to protect components of the fluid transport system from damage due to uneven flow and to increase operating efficiency of the fluid transport system. In particular, the embodiments described herein reduce surges and slugs in the fluid flow. The embodiments described herein also provide control of the gas volume fraction of fluid at the inlet of a multiphase pump. In some embodiments, the controller controls the flow control devices to control fluid flow through the fluid transport system based on at least one operating characteristic of the fluid transport system. In some embodiments, the controller determines a predicted value for the at least one operating characteristic of the fluid transport system and correlates the predicted value to a measured value of at least one operating characteristic of the fluid transport system. Based on the correlation, the controller controls components of the fluid transport system to adjust operation of the fluid transport system and increase the efficiency of the fluid transport system.

FIG. 1 is a schematic view of an exemplary fluid transport system 100 configured to pump a multiphase flow of fluid 102 from an oilfield 104 to a topside production facility 106. Fluid transport system 100 includes at least one flow control device 108, a multiphase pump 110, an intake 112, and a riser 114. Riser 114 includes a base portion 116 and a topside portion 118 at a higher elevation than base portion 116. Intake 112 is coupled to an inlet pipe 119 of multiphase pump 110 and riser 114 is coupled to an outlet pipe 121 of multiphase pump 110. During operation of fluid transport system 100, multiphase pump 110 pumps a fluid 102 through fluid transport system 100 such that fluid 102 flows from oilfield 104 into intake 112 and through riser 114 from base portion 116 to topside portion 118. A topside choke valve 120 is coupled to riser 114 and a wellhead valve 122 is coupled to intake 112. Topside choke valve 120 and wellhead valve 122 facilitate controlling flow of fluid 102 through intake 112 and riser 114 to control production of fluid transport system 100.

Fluid transport system 100 further includes a slug catcher 124 and a separator 126. Slug catcher 124 is configured to remove slugs traveling in fluid 102 by containing a diverted volume of fluid 102 that is in a gaseous state. In the exemplary embodiment, slug catcher 124 is coupled to intake 112 upstream of multiphase pump 110 and to base portion 116 of riser 114 downstream of multiphase pump 110. In alternative embodiments, slug catcher 124 is any passive control system that enables fluid transport system 100 to function as described herein. In the exemplary embodiment, separator 126 separates multiphase fluid 102 into different phases. In alternative embodiments, separator 126 is any separator that enables fluid transport system 100 to operate as described herein. In the exemplary embodiment, separator 126 and slug catcher 124 are in fluid communication via a bypass line 128 such that portions of fluid 102 are transported past multiphase pump 110. A safety valve 130 is included along bypass line 128. In alternative embodiments, bypass line 128 includes any valves that enable fluid transport system 100 to operate as described herein.

A recirculation line 132 is coupled to riser 114 and intake 112 such that fluid 102 is recirculated through recirculation line 132 from downstream of multiphase pump 110 to upstream of multiphase pump 110. In some embodiments, recirculation line 132 is used as an active surge control for fluid transport system 100. A recirculation valve 134 is coupled to recirculation line 132 to control flow of fluid 102 through recirculation line 132. Recirculation valve 134 is positionable in a plurality of positions to selectively allow an amount of fluid 102 to flow through recirculation valve 134. For example, in some embodiments, recirculation valve 134 is positionable in an at least partially closed position to inhibit fluid 102 flowing through recirculation line 132 and in an at least partially open position to allow fluid 102 to flow through recirculation line 132. In alternative embodiments, recirculation valve 134 is any valve that enables fluid transport system 100 to operate as described herein.

In the exemplary embodiments, fluid transport system 100 includes a plurality of flow control devices 108 to facilitate controlling flow of fluid 102 through fluid transport system 100. Flow control devices 108 include recirculation valve 134, topside choke valve 120, wellhead valve 122, safety valve 130, and any other flow control devices that enable fluid transport system 100 to operate as described herein. In the exemplary embodiment, a regulating device 136 is coupled to each flow control device 108. In alternative embodiments, regulating devices 136 are coupled to any components of fluid transport system 100 that enable fluid transport system 100 to operate as described herein. In the exemplary embodiment, regulating device 136 causes flow control device 108 to move between at least partially open position and an at least partially closed position. In the exemplary embodiment, regulating device 136 is modulated to cause flow control device 108 to move to a selected position. In alternative embodiments, regulating device 136 is any regulator that enables flow control device 108 to operate as described herein. In some embodiments, regulating device 136 is omitted.

In the exemplary embodiment, a pump sensing device 138 is coupled to multiphase pump 110 to measure a value of at least one operating characteristic of multiphase pump 110. Pump sensing device 138 measures at least one of a pressure, a temperature, a flow rate, a pump shaft position, a valve actuator position, power usage, operating speed, and any other operating characteristic of multiphase pump 110. For example, in some embodiments, pump sensing device 138 includes a sensor configured to measure a power consumption of multiphase pump 110. In further embodiments, pump sensing device 138 measures an inlet pressure at inlet pipe 119 and an outlet pressure at outlet pipe 121. Using the measured inlet pressure and outlet pressure, a differential pressure across multiphase pump 110 is determined. In some embodiments, pump sensing device 138 measures a total volume flow rate through multiphase pump 110. In further embodiments, pump sensing device 138 measures a multiphase flow rate including volume flow rates for each phase such that a gas volume fraction is determined. In still further embodiments, pump sensing device 138 measures pump shaft positions such that an operating speed of multiphase pump 110 is determined. In alternative embodiments, pump sensing device 138 measures values of any operating characteristics of multiphase pump 110. In further embodiments, fluid transport system 100 includes any pump sensing devices 138 that enable fluid transport system 100 to operate as described herein.

In the exemplary embodiment, fluid transport system 100 further includes a plurality of fluid sensing devices 140 that measure characteristics of fluid 102 flowing through fluid transport system 100. Fluid sensing devices 140 measure at least one of a pressure, temperature, flow rate, liquid level, and any other flow characteristics of fluid 102 flowing through fluid transport system 100. Fluid sensing devices 140 are disposed adjacent riser 114, recirculation line 132, slug catcher 124, separator 126, and any other components of fluid transport system 100 that enable fluid transport system 100 to operate as described herein. Some fluid sensing devices 140 are positioned in slug catcher 124 and separator 126 and are configured to measure the liquid level in slug catcher 124 and separator 126. Additional fluid sensing devices 140 are positioned adjacent slug catcher 124 and are configured to measure multiphase flow rate through slug catcher 124 to facilitate determining a gas volume fraction. In addition, fluid sensing devices 140 configured to measure pressure and temperature are positioned adjacent wellhead valve 122, topside choke valve 120, slug catcher 124, and separator 126. In alternative embodiments, fluid transport system 100 includes any fluid sensing devices 140 that enable fluid transport system 100 to operate as described herein.

In the exemplary embodiment, a controller 142 is coupled to and communicates with pump sensing devices 138, fluid sensing devices 140, and regulating devices 136. Specifically, controller 142 sends signals to and receives signals from pump sensing devices 138, fluid sensing devices 140, and regulating devices 136. Controller 142 includes a processing device 144 and a memory device 146 coupled to processing device 144. In alternative embodiments, controller 142 includes any components that enable fluid transport system 100 to operate as described herein. In the exemplary embodiments, controller 142 receives an operating characteristic of fluid transport system 100 from at least one of pump sensing device 138 and fluid sensing device 140. Based on the operating characteristic, controller 142 sends a signal to regulating device 136. In the exemplary embodiment, controller 142 sends a signal to regulating device 136 that causes regulating device 136 to modulate such that flow control device 108 is moved to a selected position. For example, in some embodiments, controller 142 receives signals from pump sensing device 138 relating to at least one of the speed of multiphase pump 110 and the differential pressure across multiphase pump 110. Controller 142 causes regulating device 136 to modulate such that flow of fluid 102 through flow control device 108 is adjusted to facilitate the differential pressure across multiphase pump 110 reaching a set point value. In alternative embodiments, controller 142 causes regulating device 136 to modulate based on any values that enable fluid transport system 100 to operate as described herein. In further embodiments, controller 142 causes a plurality of regulating devices 136 associated with flow control devices 108 to modulate based on at least one operating characteristic of fluid 102 and based on feedback from each regulating device 136.

In the exemplary embodiment, a valve position sensor 148 is coupled to each flow control device 108. In particular, valve position sensors 148 are coupled to each of recirculation valve 134, topside choke valve 120, wellhead valve 122, and safety valve 130. In alternative embodiments, multiphase pumping assembly 100 includes any valve position sensors 148 that enable multiphase pumping assembly 100 to operate as described herein. In the exemplary embodiment, controller 142 receives signals from fluid sensing device 140 and valve position sensor 148 relating to the position of a valve in flow control devices 108. Controller 142 correlates the valve position to a flow rate, either measured or estimated. Based on the correlation, controller 142 determines a desired position of flow control device 108 and controller 142 sends a signal to regulating device 136 to cause flow control device 108 to move to the desired position.

In some embodiments, controller 142 controls operation of fluid transport system 100 to stabilize at least one operating characteristic of fluid transport system 100 and, thereby, increase operating efficiency of fluid transport system 100, reduce slugs traveling through fluid transport system 100, and/or control surge of fluid transport system 100. Operating characteristics include, without limitation, suction pressure of multiphase pump 110, discharge pressure of multiphase pump 110, differential pressure across multiphase pump 110, pressure in base portion 116, pressure in topside portion 118, differential pressure across riser 114, mass/volumetric flow through multiphase pump 110, and mass/volumetric flow through topside choke valve 108.

In some embodiments, controller 142 uses automatic feedback control to control a component of fluid transport system 100 and, thereby, stabilize at least one operating characteristic of fluid transport system 100. During automatic feedback control, controller 142 sends signals to the component of fluid transport system 100 relating to stabilizing the at least one operating characteristic of fluid transport system 100. Then, controller 142 receives signals relating to the stabilization of the at least one operating characteristic and sends additional signals based on the received signals. For example, in some embodiments, controller 142 sends signals to topside choke valve 120 to cause topside choke valve 120 to move to a position that facilitates stabilizing the at least one operating characteristic of fluid transport system 100. Then, controller 142 receives signals relating to a base pressure of riser 114 and determines whether repositioning topside choke valve 120 would facilitate stabilizing the base pressure. If necessary, controller 142 sends additional signals to topside choke valve 120 to reposition topside choke valve 120.

In some embodiments, controller 142 uses automatic feedback control to control the speed of multiphase pump 110 and, thereby, stabilize at least one operating characteristic of fluid transport system 100. For example, controller 142 sends signals to cause multiphase pump 110 to change speed and receives signals relating to the stabilization of the at least one operating characteristic. If necessary, controller 142 sends additional signals to multiphase pump 110 based on the received signals. For example, in some embodiments, controller 142 sends signals to multiphase pump 110 to facilitate stabilizing a differential pressure across multiphase pump 110.

In some embodiments, pump speed of multiphase pump 110 is controlled to increase pump efficiency. The pump speed is determined as a function of other operating characteristics such as GVF, suction pressures, and discharge pressures. Controller 142 determines a desired pump speed of multiphase pump 110 that increases pump efficiency and sends a signal to multiphase pump 110 to cause multiphase pump 110 to operate at the determined pump speed. In alternative embodiments, controller 142 determines any operating characteristic of multiphase pump 110 that enables multiphase pump system 100 to operate as described herein.

In some embodiments, controller 142 controls topside choke valve 120 based on a pressure at base portion 116 of riser 114. Controller receives a signal from fluid sensing device 140 relating to the pressure at base portion 116 and modulates regulating device 136 to control the position of topside choke valve 120 to facilitate the pressure at base portion 116 reaching a set point value. In alternative embodiments, controller 142 controls topside choke valve 120 based on any values that enable fluid transport system 100 to operate as described herein.

Figure 2:
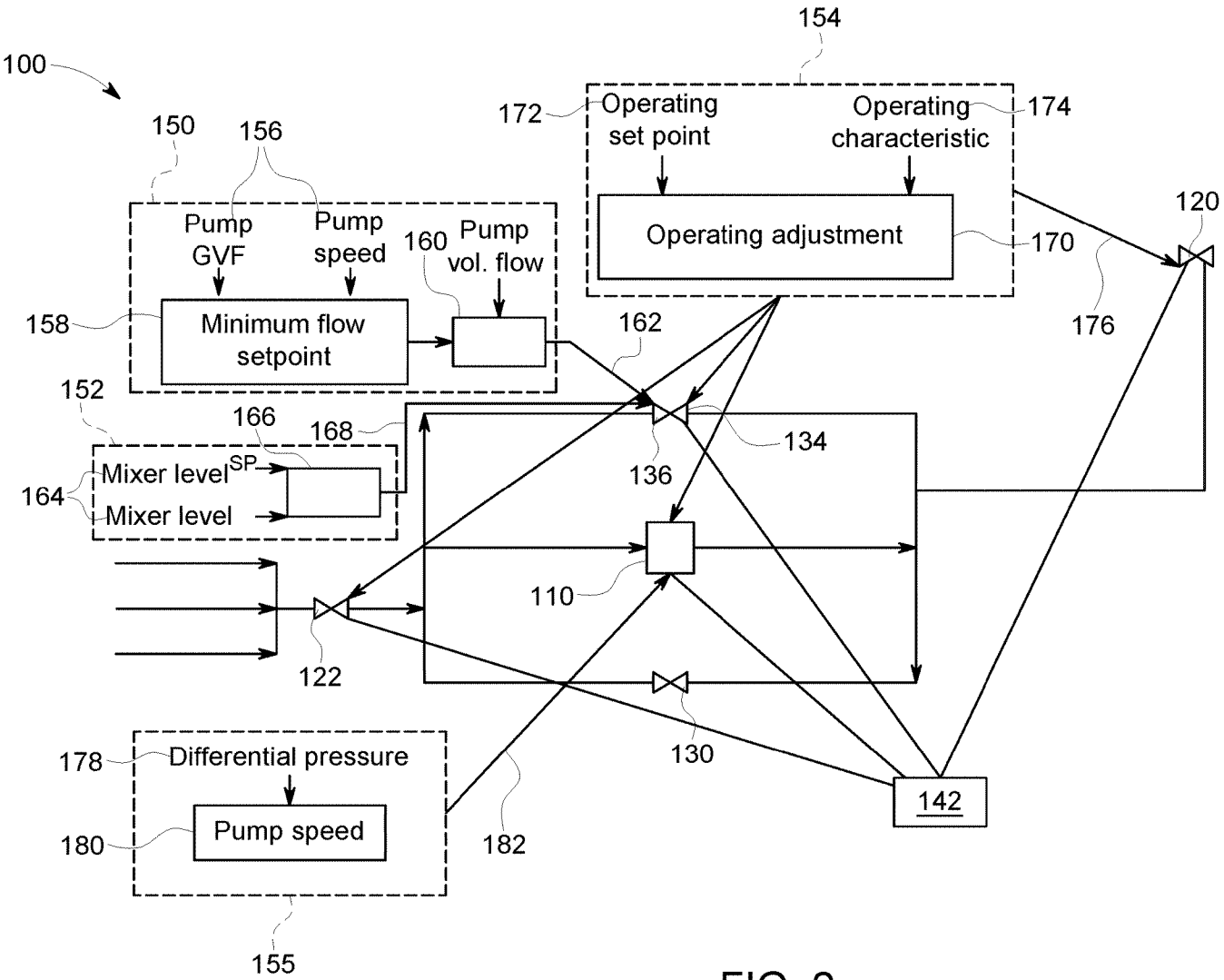
FIG. 2 is a schematic view of an exemplary control diagram for controlling the fluid transport system shown in FIG. 1.

FIG. 2 is a schematic view of an exemplary control diagram for controlling fluid transport system 100. In the exemplary embodiment, controller 142 communicates with pump 110, recirculation valve 134, topside choke valve 120, wellhead valve 122, and safety valve 130 to control fluid transport system 100. As such, controller 142 is a centralized controller. In alternative embodiments, fluid transport system 100 is configured for decentralized control having any number of controllers 142 that enable fluid transport system 100 to operate as described herein. For example, in some embodiments, at least one of pump 110, recirculation valve 134, topside choke valve 120, wellhead valve 122, and safety valve 130 have a separate controller 142. In the exemplary embodiment, controller 142 controls pump 110, recirculation valve 134, topside choke valve 120, wellhead valve 122, and safety valve 130 based on a control operation 150, a control operation 152, a control operation 154, and/or a control operation 155. In alternative embodiments, controller 142 performs any control operations that enable multiphase pump system 100 to operate as described herein.

In the exemplary embodiment, control operation 150 includes receiving signals relating to pump characteristics 156 and determining a minimum flow set point 158 based on pump characteristics 156. Controller 142 determines a desired position 160 of recirculation valve 134 based on minimum flow set point 158 and sends a signal 162 to regulating device 136, which causes recirculation valve 134 to move to desired position 160. In some embodiments, pump characteristics 156 include, without limitation, at least one of the following: pump differential pressure, pump speed, and gas volume fraction. In further embodiments, control operation 150 incorporates a margin such that recirculation valve 134 regulates situations where the gas volume fraction is at a rated capacity of fluid transport system 100.

Also, in the exemplary embodiment, control operation 152 includes measuring liquid levels 164 at points of fluid transport system 100 and determining a position 166 of recirculation valve 134 based on liquid levels 164. In some embodiments, liquid levels 164 at slug catcher 124 are measured and sent to controller 142 for performing control operation 152. After performing control operation 152, controller 142 sends a signal 168 to recirculation valve 134 to cause recirculation valve 134 to move to the desired position 166.

Further, in the exemplary embodiment, control operation 154 includes determining an operating adjustment 170 based on an operating set point 172 and an operating characteristic 174 of fluid transport system 100. For example, in some embodiments, control operation 154 includes determining operating adjustment 170 based on the gas volume fraction at inlet pipe 119 and/or at intake 112. In alternative embodiments, control operation 154 includes determining operating adjustment 170 based on any variables of fluid transport system 100 that enable fluid transport system 100 to operate as described herein. In some embodiments, controller 142 sends a signal 176 to any of pump 110, recirculation valve 134, topside choke valve 120, wellhead valve 122, and/or safety valve 130 to adjust operation of fluid transport system 100 based on operating adjustment 170. In the exemplary embodiment, signal 176 is sent at least to recirculation valve 134 to adjust the fluid 102 flowing through recirculation line 132. In alternative embodiments, signal 176 is sent to any components of fluid transport system 100 that enable fluid transport system 100 to operate as described herein. For example, in some embodiments, controller 142 is used to control production of fluid transport system 100. Control operation 154 includes using an algorithm to predict the evolution of production demand based on operating set points 172 and measured operating characteristics 174 of fluid transport system 100. Controller 142 performs control operation 154 to determine operating adjustment 170 and sends signal 176 to cause fluid transport system 100 to adjust production to meet the production demand.

Moreover, in the exemplary embodiment, control operation 155 includes measuring a differential pressure 178 across multiphase pump 110 and determining a pump speed 180 based on differential pressure 178. In alternative embodiments, control operation 155 includes determining pump speed 180 based on any operating characteristics of fluid transport system 100. In the exemplary embodiment, controller 142 performs control operation 155 and sends a signal 182 to multiphase pump 110 based at least in part on control operation 155. Signal 182 causes multiphase pump 110 to operate at pump speed 180. In alternative embodiments, signal 182 is sent to any components of fluid transport system 100 that cause multiphase pump 110 to operate at pump speed 180.

In some embodiments, operating characteristics of fluid transport system 100 are estimated and/or calculated. For example, some embodiments of controlling fluid transport system 100 include calculating and/or estimating, without limitation, volume flow through multiphase pump 110, gas volume fraction (GVF) at the inlet of separator 126, GVF at inlet pipe 119 of multiphase pump 110, well bottom hole pressure, and/or base pressure of riser 114. Estimating and/or calculating operating characteristics allows controller 142 to accurately control fluid transport system 100 when operating characteristics are unavailable and/or difficult to obtain. For example, in some embodiments operating characteristics are not measured because of a harsh environment, prohibitive cost of sensors, and sensor accuracy issues. In addition, calculating and/or estimating operating characteristics provides increased reliability and allows for the use of available measurements. Estimating and/or calculating operating characteristics involve the use of, without limitation, data-driven and physics-based models.

In some embodiments, operating characteristics such as GVF are calculated and/or estimated using models based on pump performance data. For example, in some embodiments, pump maps are interpolated based on operating characteristics such as speed of multiphase pump 110, GVF, suction pressure, discharge pressure, density of flow through inlet pipe 119 and density of flow through outlet pipe 121. In further embodiments, operating characteristics such as GVF are calculated and/or estimated in any manner that enable fluid transport system 100 to operate as described herein. For example, in some embodiments, multiphase pump 110 is used as a sensor. Inverted pump maps and/or correlations for GVF are determined based on a function of at least one operating characteristic such as liquid level, volume flow through fluid transport system 100, speed of multiphase pump 110, differential pressure across multiphase pump 110, pressure head in fluid transport system 100, and power used by multiphase pump 110.

In some embodiments, operating characteristics are determined using iterative methods based on pump maps and/or simplified system models. In some embodiments, the iterative methods uses recursive least squares and/or extended Kalman filter embodiments. In alternative embodiments, the iterative methods use any techniques that enable fluid transport system 100 to operate as described herein. In further embodiments, operating characteristics are determined using any methods that enable fluid transport system 100 to operate as described herein.

In the exemplary embodiment, controller 142 is programmed with a pump map includes a correlation of at least one operating characteristic of multiphase pump 110 with at least one operating characteristic of fluid. Controller 142 is configured to receive from pump sensing device 138 a measured value of the at least one operating characteristic of multiphase pump 110. Based on the pump map and the measured value, controller 142 determines an estimated value of the at least one operating characteristic of fluid and sends a signal to regulating device 136. In alternative embodiments, controller 142 determines the estimated value in any manner that enables fluid transport system 100 to operate as described herein. In the exemplary embodiment, controller 142 receives measured values of power consumption of multiphase pump 110 and differential pressure between inlet pipe 119 and outlet pipe 121. The pump map correlates power consumption of multiphase pump 110 and differential pressure between inlet pipe 119 and outlet pipe 121 with values of GVF. Accordingly, an estimated GVF is determined based on the pump map and the measured values of power consumption of multiphase pump 110 and differential pressure between inlet pipe 119 and outlet pipe 121. Controller 142 sends signals to regulating device 136 based on the estimated GVF.

Figure 3:
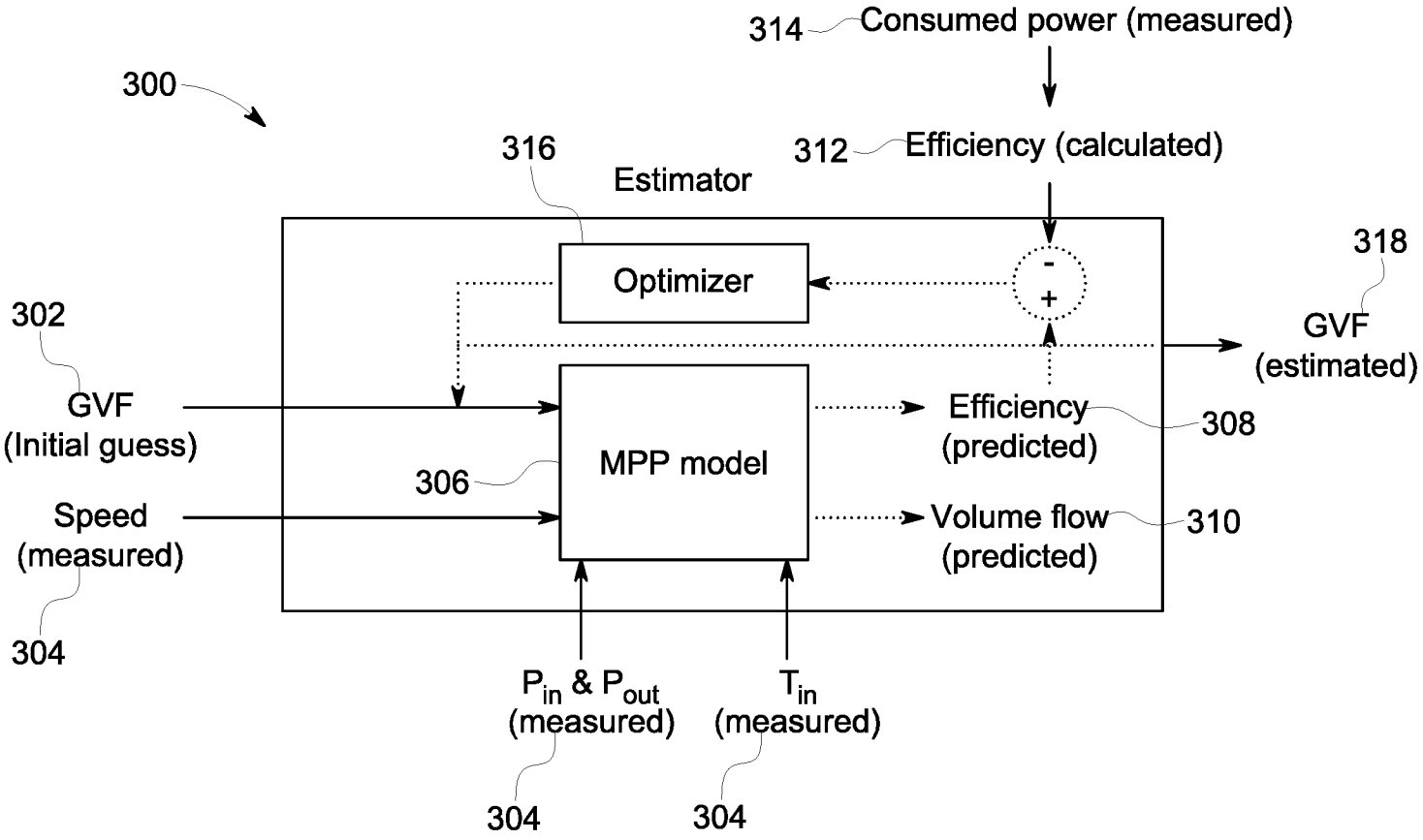
FIG. 3 is a schematic view of an exemplary estimator configured to estimate a gas volume fraction of the multiphase flow at an inlet of a multiphase pump shown in FIG. 1.

FIG. 3 is a schematic view of an estimator 300 configured to estimate a gas volume fraction (GVF) of the multiphase flow at inlet pipe 119 of multiphase pump 110. Estimator 300 receives input 302 such as the initial estimate of GVF at inlet pipe 119 and measured values 304 such as speed of multiphase pump 110, input power, output power, and temperature. In alternative embodiments, estimator 300 receives any inputs 302 and/or measured values 304 that enable estimator 300 to operate as described herein. In the exemplary embodiment, estimator 300 runs a multiphase pump model 306 based on inputs 302 and measured values 304 and determines a predicted efficiency 308 and a predicted volume flow 310. Estimator 300 calculates a calculated efficiency 312 based on a consumed power 314 and compares calculated efficiency 312 and predicted efficiency 308. Calculated efficiency 312 and predicted efficiency 308 are inputted in an optimizer 316 for comparison. Optimizer 316 determines an estimated GVF 318. If necessary, additional iterations of multiphase pump model 306 are run based on estimated GVF 318.

Figure 4:
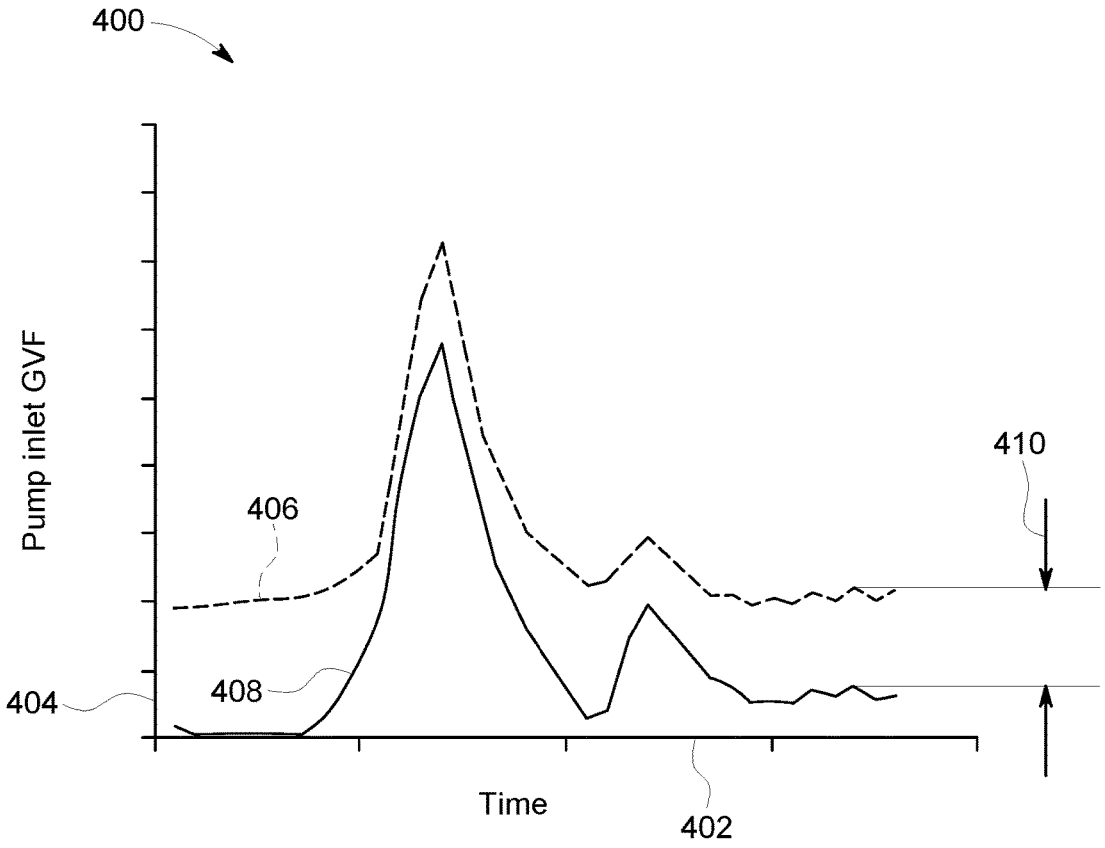
FIG. 4 is an exemplary graphical view of a comparison between an actual gas volume fraction at the inlet of the multiphase pump and an estimated gas volume fraction estimated by the estimator shown in FIG. 3.

FIG. 4 is an exemplary graphical view of a comparison between an actual gas volume fraction at inlet pipe 119 of multiphase pump 110 and an estimated gas volume fraction estimated by estimator 300. FIG. 4 includes a graph 400 including an x-axis 402 defining a time. Graph 400 further includes a y-axis 404 defining a topside production flow. Also, graph 400 includes a curve 406 and a curve 408. Curve 406 represents actual gas volume fraction at inlet pipe 119 of multiphase pump 110 and curve 408 represents estimated gas volume fraction at inlet pipe 119 of multiphase pump 110. Curve 406 and curve 408 are separated by a distance 410. In the exemplary embodiment, curve 408 is below curve 406 such that estimated gas volume fraction is less than actual gas volume fraction to provide a conservative margin of error.

Figure 5:
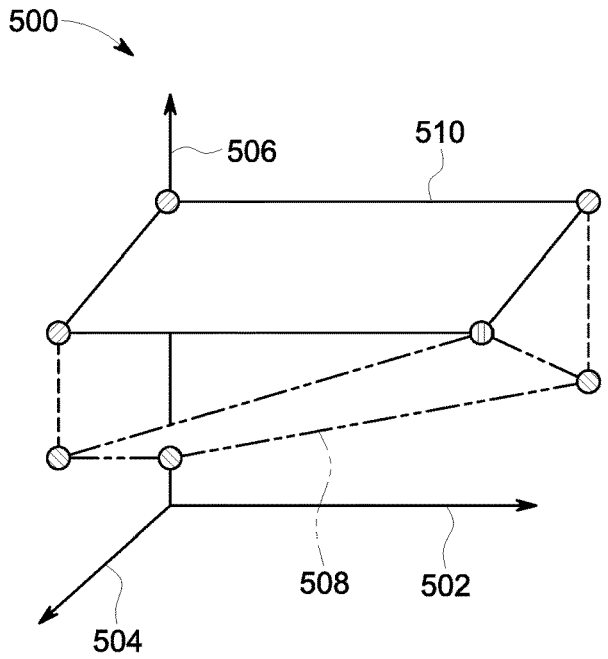
FIG. 5 is an exemplary graphical view of a static system operating map for use by a controller according to the control diagram shown in FIG. 2.

FIG. 5 is a graphical view of a static system operating map 500 for use by controller 142. System operating map 500 correlates valve position with operating characteristics of fluid transport system 100 to facilitate controller 142 determining a desired position of recirculation valve 134. Static system operating map 500 is generated using a set of operating characteristics of fluid transport system 100. For example, in some embodiments, static system operating map 500 is based on gas volume fraction and pump speed. System operating map 500 correlates operating characteristics of fluid transport system 100 including, without limitation, pump characteristics, valve sizes, recirculation line geometries, component volumes, and system design. In the exemplary embodiment, static system operating map 500 includes a first variable axis 502, a second variable axis 504 perpendicular to first variable axis 502, and a third variable axis 506 perpendicular to both first variable axis 502 and second variable axis 504. Inputs are plotted along first variable axis 502 and second variable axis 504. Valve positions are plotted along third variable axis 506. The number of inputs used to generate system operating map 500 determines the number of dimensions, i.e., axes, of system operating map 500. In the exemplary embodiment, system operating map 500 includes two inputs such that a 3-D surface 508 is plotted on system operating map 500. In some embodiments, one input is considered such that a 2-D line is plotted on system operating map 500. In alternative embodiments, system operating map 500 is generated from any inputs that enable controller 142 to function as described herein.

A surface 510 illustrates the valve opening position of a continuous recirculation process for the various operating positions of fluid transport system 100. As such, surface 510 represents the valve positions that result in the maximum recirculation rate, i.e., worst case scenario, for fluid transport system 100. Points below surface 510 result in a reduced overall recirculation rate which increases operating efficiency of fluid transport system 100. In the exemplary embodiment, surface 508 is entirely below surface 510. Accordingly, fluid transport system 100 has an increased operating efficiency when controller 142 controls recirculation valve 134 such that fluid transport system is operating along surface 508. Increasing the number of inputs allows for a greater distance between surface 510 and surface 508, which results in greater operating efficiency gains. However, the number of inputs must be balanced with the information available and the number of sensors required to gather information. In the exemplary embodiment, system operating map 500 is used by controller 142 to control recirculation valve 134. In alternative embodiments, system operating map 500 is used to control any valve of fluid transport system 100 that enables fluid transport system 100 to operate as described herein.

Figure 6:
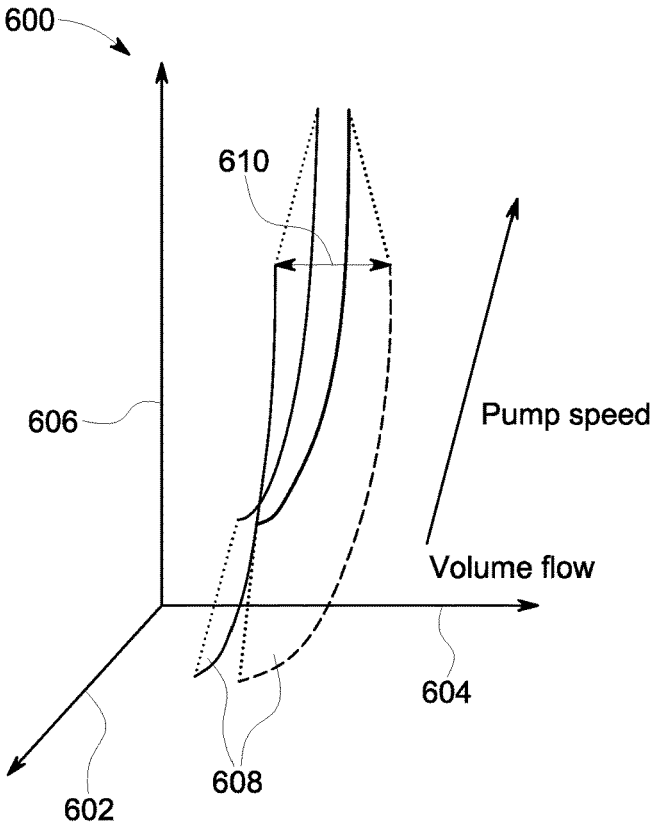
FIG. 6 is an exemplary graphical view of a pump map for use by a controller according to the control diagram shown in FIG. 2.

FIG. 6 is a graphical view of a pump map 600 for use by controller 142. In some embodiments, controller 142 utilizes pump map 600 to control fluid transport system 100 such that surge is inhibited in fluid transport system 100. Pump map 600 includes a y-axis 602 indicating gas volume fraction, an x-axis 604 indicating volume flow, and a z-axis 606 indicating pressure head. Surfaces 608 are plotted on pump map 600 illustrating operating points of pump 110. A surge margin 610 is defined between surfaces 608 and indicates operating points where fluid transport system 100 may have flow surge. When using pump map 600, the current operating point of fluid transport system 100 is estimated and located on pump map 600. If the operating point lies within surge margin 610, recirculation valve 134 is moved to a position allowing additional flow through recirculation line 132 to inhibit flow surge. In some embodiments, surge margin 610 depends on at least one of the pump speed and a gas volume fraction.

Figure 7:
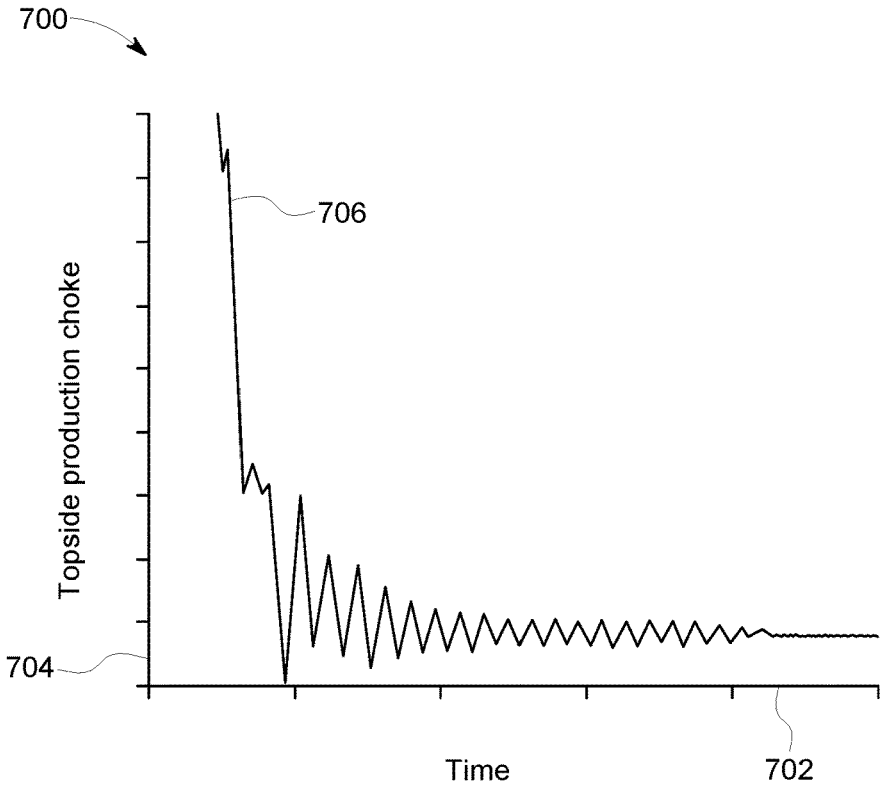
FIG. 7 is an exemplary graphical view of control of a topside choke valve according to the control diagram shown in FIG. 2 to control slugging flow based on a riser base pressure.

FIG. 7 is an exemplary graphical view of control of topside choke valve to control slugging flow according to the control diagram shown in FIG. 2 based on a riser base pressure. FIG. 7 includes a graph 700 including an x-axis 702 defining a time. Graph 700 further includes a y-axis 704 defining a topside production choke. Also, graph 700 includes a curve 706. Curve 706 represents production through topside choke valve 120 during control of topside choke valve 120 according to the described embodiments. Curve 706 starts at a high percentage and fluctuates along x-axis 702. As controller 142 stabilizes operating characteristics of fluid transport system 100, curve 706 levels out.

Figure 8:
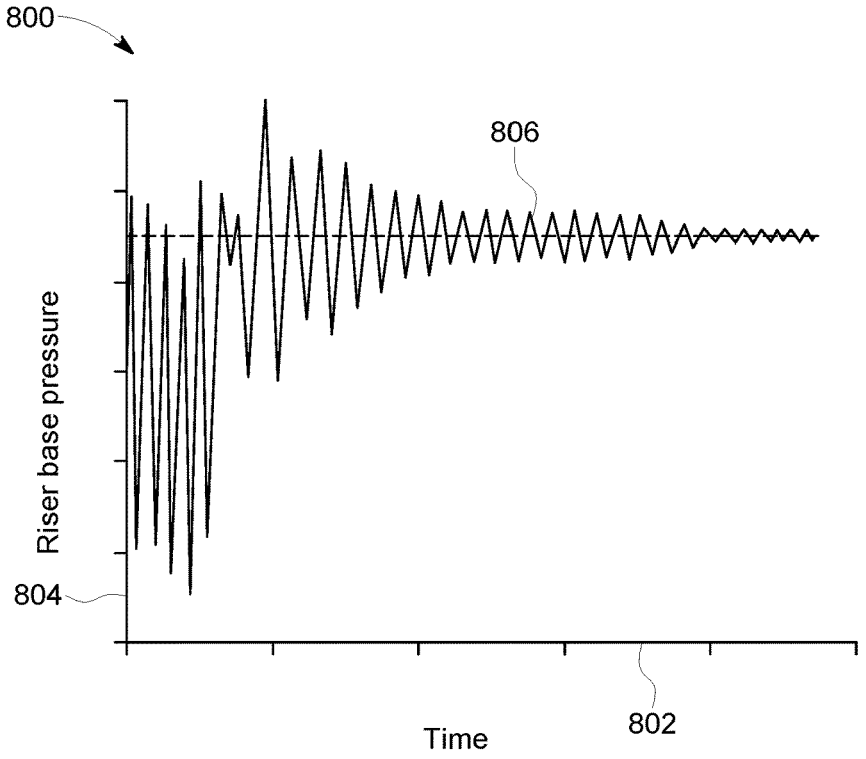
FIG. 8 is an exemplary graphical view of the riser base pressure used to control the choke valve as shown in FIG. 7.

FIG. 8 is an exemplary graphical view of base pressure of riser 114 used to control topside choke valve 120. FIG. 8 includes a graph 800 including an x-axis 802 defining a time. Graph 800 further includes a y-axis 804 defining a base pressure of riser 114. Also, graph 800 includes a curve 806. Curve 806 represents the base pressure of riser 114 during control of topside choke valve 120 according to the described embodiments. Curve 806 initially fluctuates along x-axis 802. As the pressure of riser 114 fluctuates, controller 142 receives signals relating to the pressure of riser 114 and determines positioning of topside choke valve 120 based on the pressure. As controller 142 stabilizes the pressure of fluid transport system 100, curve 806 levels out.

Figure 9:
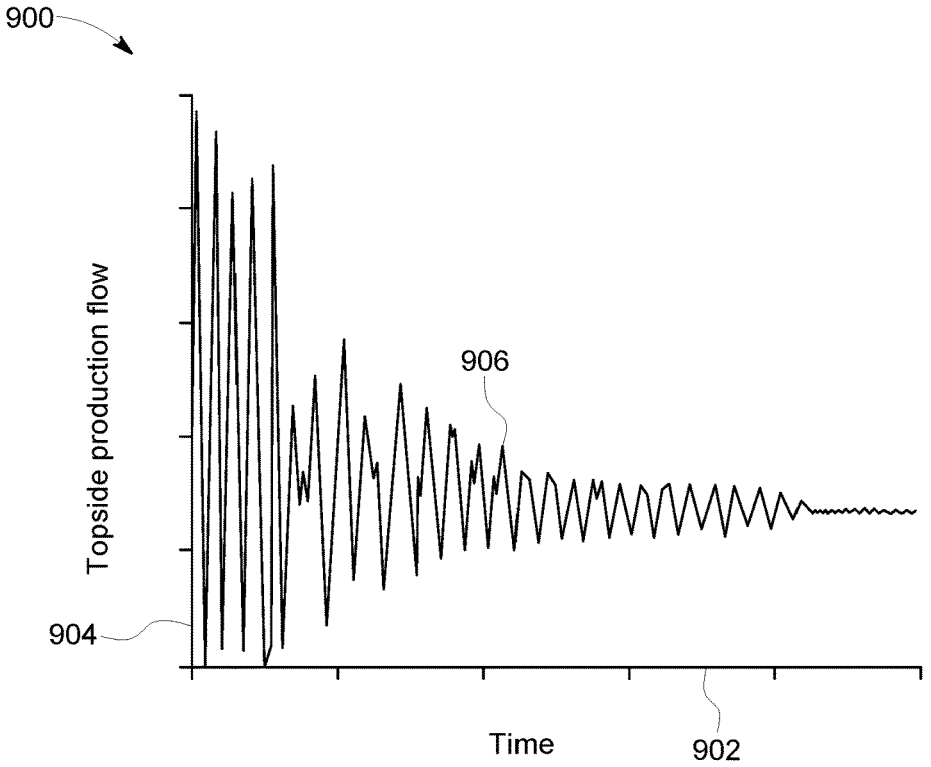
FIG. 9 is an exemplary graphical view of a topside production flow which results from the topside choke control shown in FIG. 7.

FIG. 9 is an exemplary graphical view of a topside production flow which results from control of topside choke valve 120. FIG. 9 includes a graph 900 including an x-axis 902 defining a time. Graph 900 further includes a y-axis 904 defining a topside production flow. Also, graph 900 includes a curve 906. Curve 906 represents production through topside choke valve 120 during control of topside choke valve 120 according to the described embodiments. Curve 906 initially fluctuates along x-axis 902. As controller 142 stabilizes production flow of fluid transport system 100, curve 906 levels out. Stabilizing production flow inhibits slugs forming in fluid transport system 100 and causes fluid transport system 100 to operate more efficiently.

Figure 10:
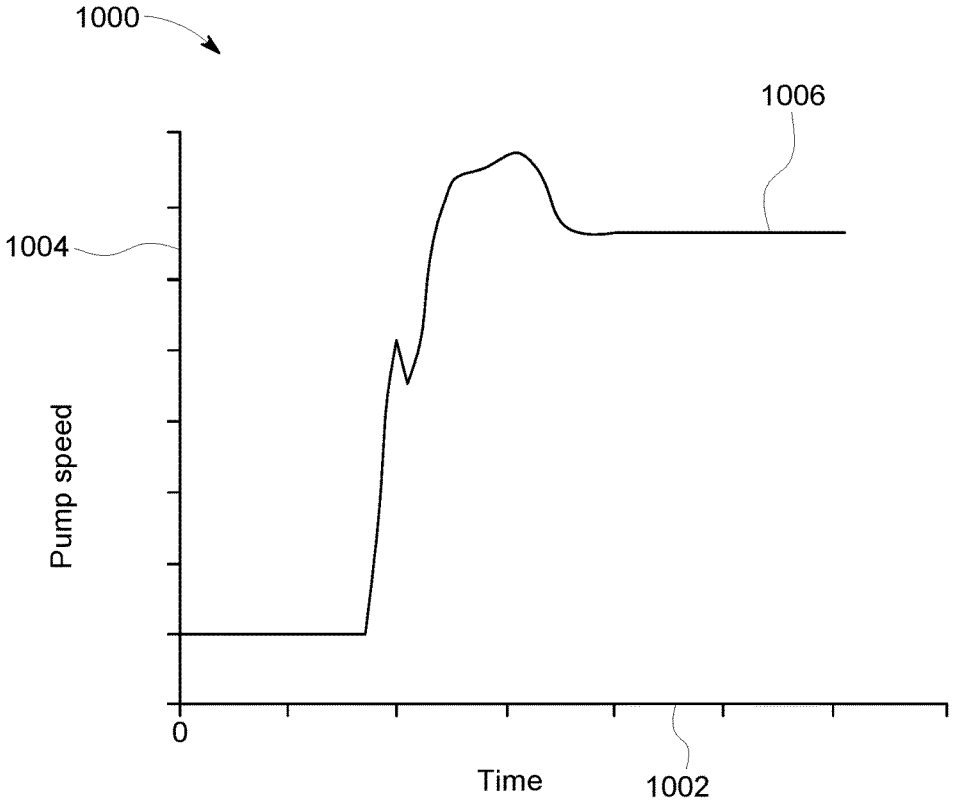
FIG. 10 is an exemplary graphical view of control of a pump speed of the multiphase pump according to the control diagram shown in FIG. 2 to control slugging flow based on a differential pressure across the multiphase pump.

FIG. 10 is an exemplary graphical view of control of a pump speed of multiphase pump 110 according to the control diagram shown in FIG. 2 to control slugging flow based on a differential pressure across multiphase pump 110. FIG. 10 includes a graph 1000 including an x-axis 1002 defining a time. Graph 1000 further includes a y-axis 1004 defining a pump. Also, graph 1000 includes a curve 1006. Curve 1006 represents pump speed of multiphase pump 110 during control of multiphase pump 110 according to the described embodiments. Curve 1006 initially fluctuates along x-axis 1002. As controller 142 stabilizes the operating characteristics of fluid transport system 100, curve 1006 levels out.

Figure 11:
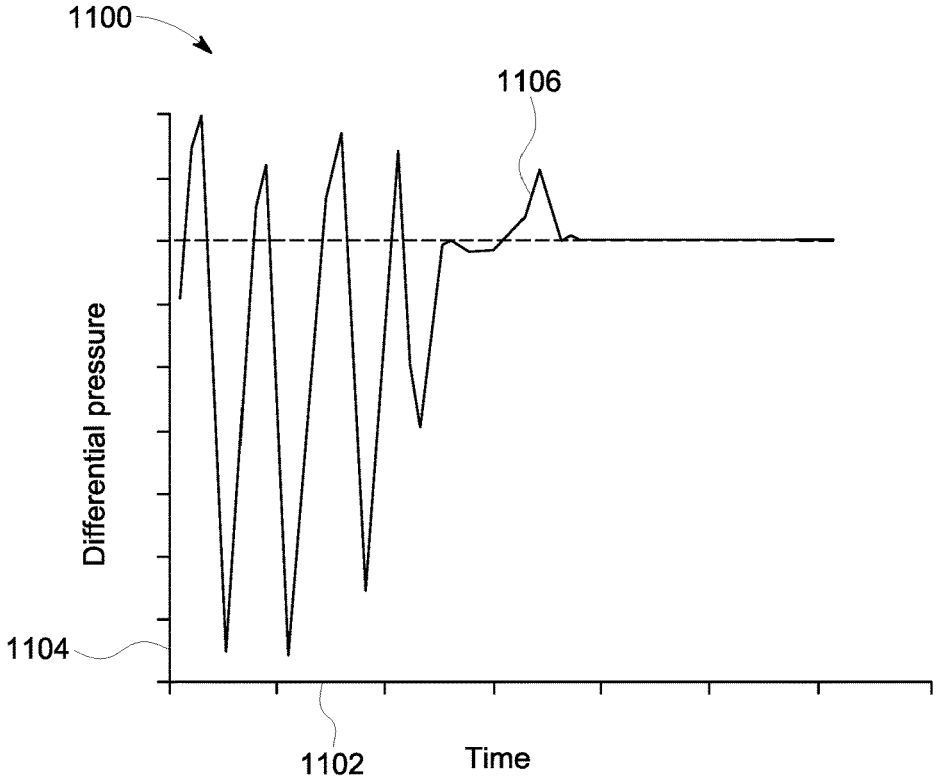
FIG. 11 is an exemplary graphical view of the differential pressure across the multiphase pump used to control the pump speed of the multiphase pump as shown in FIG. 10.

FIG. 11 is an exemplary graphical view of the differential pressure across the multiphase pump 110 used to control the pump speed of multiphase pump 110 as shown in FIG. 10. FIG. 11 includes a graph 1100 including an x-axis 1102 defining a time. Graph 1100 further includes a y-axis 1104 defining a differential pressure. Also, graph 1100 includes a curve 1106. Curve 1106 represents differential pressure across multiphase pump 110 during control of multiphase pump 110 according to the described embodiments. Curve 1106 initially fluctuates along x-axis 1002. As controller 142 stabilizes the operating characteristics of fluid transport system 100, curve 1106 levels out. Controller 142 receives signals relating to the differential pressure and determines additional adjustments of the speed of multiphase pump 110 based on the pressure.

Figure 12:
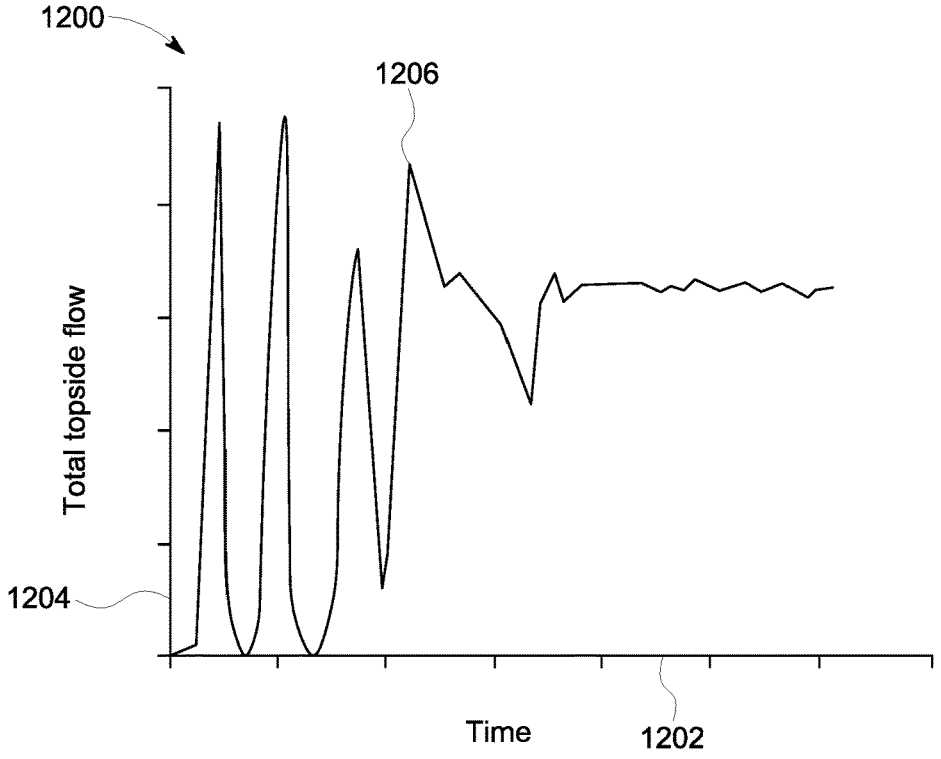
FIG. 12 is an exemplary graphical view of a topside production flow which results from the pump speed control of the multiphase pump shown in FIG. 10.

FIG. 12 is an exemplary graphical view of a topside production flow which results from the pump speed control of multiphase pump 110 shown in FIG. 10. FIG. 12 includes a graph 1200 including an x-axis 1202 defining a time. Graph 1200 further includes a y-axis 1204 defining a topside production flow. Also, graph 1200 includes a curve 1206. Curve 1206 represents production through topside choke valve 120 during control of multiphase pump 110 according to the described embodiments. Curve 1206 initially fluctuates along x-axis 1202. As controller 142 stabilizes the production flow of fluid transport system 100, curve 1206 levels out. Stabilizing production flow inhibits slugs forming in fluid transport system 100 and causes fluid transport system 100 to operate more efficiently.

In reference back to FIG. 1, in some embodiments, overall production of fluid transport system 100 is controlled by controlling fluid transport system 100, upstream subsystems (not shown), and/or downstream subsystems (not shown). In the exemplary embodiment, fluid transport system 100 is controlled as described above to facilitate pump surge control, pump GVF control, and/or anti-slug control. In addition, fluid transport system 100, upstream subsystems (not shown), and/or downstream subsystems (not shown) are controlled using any control device, such as wellhead valve 122, multiphase pump 110, recirculation valve 134, and/or topside choke valve 120. Control devices of fluid transport system 100, upstream subsystems (not shown), and/or downstream subsystems (not shown) are controlled based on operating characteristics including any of the following, without limitation: well bottom hole pressure, wellhead pressure, suction pressure of multiphase pump 110, discharge pressure of multiphase pump 110, differential pressure across multiphase pump 110, base pressure of riser 114, topside pressure of riser 114, differential pressure across riser 114, mass/volumetric flow through multiphase pump 110, and mass/volumetric flow through topside choke valve 120. In alternative embodiments, fluid transport system 100, upstream subsystems (not shown), and/or downstream subsystems (not shown) are controlled using any control device based on any operating characteristics that enable fluid transport system 100 to function as described herein. In the exemplary embodiment, fluid transport system 100, fluid transport system 100, upstream subsystems (not shown), and/or downstream subsystems (not shown) are controlled with a decentralized control approach including at least two separate control loops. In alternative embodiments, fluid transport system 100 and fluid transport system 100, upstream subsystems (not shown), and/or downstream subsystems (not shown) are controlled in any manner that enables fluid transport system 100 to operate as described herein.

The above described fluid transport systems include a controller to control flow control devices to protect components of the fluid transport system from damage due to uneven flow and to increase operating efficiency of the fluid transport system. In particular, the embodiments described herein reduce surges and slugs in the fluid flow. The embodiments described herein also provide control of the gas volume fraction of fluid at the inlet of a multiphase pump. In some embodiments, the controller controls the flow control devices to control fluid flow through the fluid transport system based on at least one operating characteristic of the fluid transport system. In some embodiments, the controller determines a predicted value for the at least one operating characteristic of the fluid transport system and correlates the predicted value to a measured value of at least one operating characteristic of the fluid transport system. Based on the correlation, the controller controls components of the fluid transport system to adjust operation of the fluid transport system and increase the efficiency of the fluid transport system.

An exemplary technical effect of the methods, systems, and apparatus described herein includes at least one of: (a) increasing the operating efficiency of fluid transport systems; (b) decreasing the time and cost required to maintain and repair fluid transport systems; (c) facilitating control of operating characteristics of fluid transport systems; (d) maintaining a constant fluid flow through fluid transport systems; (e) providing control of fluid surge in fluid transport systems; (f) providing control of gas volume fraction of fluid in fluid transport systems; (g) reducing slugs in fluid during operation of fluid transport systems; (h) reducing the size of passive safety components for flow control; and (i) providing for flow control without use of a topside choke valve.

Some embodiments involve the use of one or more electronic or computing devices. Such devices typically include a processor or controller, such as a general purpose central processing unit (CPU), a graphics processing unit (GPU), a microcontroller, a field programmable gate array (FPGA), a reduced instruction set computer (RISC) processor, an application specific integrated circuit (ASIC), a programmable logic circuit (PLC), and/or any other circuit or processor capable of executing the functions described herein. In some embodiments, the methods described herein are encoded as executable instructions embodied in a computer readable medium, including, without limitation, a storage device, and/or a memory device. Such instructions, when executed by a processor, cause the processor to perform at least a portion of the methods described herein. The above examples are exemplary only, and thus are not intended to limit in any way the definition and/or meaning of the term processor.

Exemplary embodiments of fluid transport systems that include a flow control device are described above in detail. The fluid transport systems that include a flow control device, and methods of operating such systems and devices are not limited to the specific embodiments described herein, but rather, components of systems and/or steps of the methods may be utilized independently and separately from other components and/or steps described herein. For example, the methods may also be used in combination with other systems, and are not limited to practice with only the multiphase pumps, fluid transport systems, and methods as described herein. Rather, the exemplary embodiment can be implemented and utilized in connection with many other pump applications that are currently configured to pump fluids, e.g., and without limitation, pumps used in oilfield production.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims

What is claimed is:

1. A fluid transport system comprising: at least one flow control device; a multiphase pump comprising an inlet pipe and an outlet pipe, wherein said multiphase pump is configured to transport a fluid; at least one sensing device configured to measure at least one operating characteristic of said multiphase pump or said fluid; at least one regulating device coupled to said at least one flow control device; and a controller coupled to said at least one sensing device and said at least one regulating device, said controller programmed with a pump map comprising a correlation of the at least one operating characteristic with a gas volume fraction of the fluid, wherein the at least one operating characteristic comprises a differential pressure across said multiphase pump, a pump speed, and a temperature at said inlet pipe, wherein said controller is configured to: receive from said at least one sensing device a measured value of the at least one operating characteristic determine a predicted efficiency of said multiphase pump based on the received measured value of the at least one operating characteristic and an initial estimate of a gas volume fraction of the fluid at the inlet pipe; determine a calculated efficiency of said multiphase pump based on a measured value of a power consumption of said multiphase pump; compare the predicted efficiency and the calculated efficiency to determine an estimated value of the gas volume fraction of the fluid; and module said at least one regulating device based on the estimated value of the gas volume fraction of the fluid.

2. The system in accordance with claim 1, wherein said controller is configured to: receive from said at least one pump sensing device measured values of the differential pressure across said multiphase pump, the pump speed, and the temperature at said inlet pipe; determine a predicted efficiency of said multiphase pump based on the initial estimate of a gas volume fraction of the fluid at the inlet pipe and the received measured values of the differential pressure across said multiphase pump, the pump speed, and the temperature at said inlet pipe; compare the predicted efficiency and the calculated efficiency to determine the estimated value of the gas volume fraction at said inlet pipe; and modulate said at least one regulating device based on the estimated value of the gas volume fraction of the fluid.

3. The system in accordance with claim 1, wherein said at least one regulating device is coupled to a recirculation valve, said recirculation valve in fluid communication with said outlet pipe, said recirculation valve in further fluid communication with said inlet pipe, wherein said controller is further configured to modulate said at least one regulating device to open and close said recirculation valve to adjust a fluid flow in a recirculation line such that the value of the gas volume fraction at said inlet pipe reaches a set point value that is less than the estimated value of the gas volume fraction of the fluid.

4. The system in accordance with claim 1, wherein said at least one flow control device comprises a recirculation valve in fluid communication with said outlet pipe, said recirculation valve in further fluid communication with said inlet pipe, said controller is further programmed with a static system operating map including a correlation of a valve position of said recirculation valve with the pump speed of said multiphase pump and the gas volume fraction at said inlet pipe, said static system operating map further including a set point plane defining a valve position of said recirculation valve based on the pump speed and the gas volume fraction, and said controller is further configured to modulate said at least one regulating device to operate said recirculation valve based on said static system operating map and said set point plane.

5. The system in accordance with claim 1, wherein said at least one flow control device comprises a plurality of flow control devices and said regulating device comprises a plurality of regulating devices associated with said plurality of flow control devices, said controller is configured to independently modulate said plurality of regulating devices based on the at least one estimated value of the gas volume fraction of the fluid.

6. The system in accordance with claim 5, wherein said controller is further configured to modulate said plurality of regulating devices based on feedback from each regulating device of said plurality of regulating devices.

7. A method for controlling a fluid transport system and flow of a fluid, said method implemented using a controller in communication with a memory and a multiphase pump configured to transport the fluid, stored, within the memory, a pump map including a correlation of at least one operating characteristic of the multiphase pump or the fluid with a gas volume fraction of the fluid, wherein the multiphase pump comprises an inlet pipe and an outlet pipe, the method comprising: receiving, from at least one sensing device in communication with the multiphase pump or the fluid and the controller, a measured value of the at least one operating characteristic, wherein the at least one operating characteristic comprises a differential pressure across said multiphase pump, a pump speed, and a temperature at said inlet pipe; determining, by the controller, a predicted efficiency of the multiphase pump based on the received measured value of the at least one operating characteristic and an initial estimate of a gas volume fraction of the fluid at the inlet pipe; determining, by the controller, a calculated efficiency of the multiphase pump based on a measured value of a power consumption of said multiphase pump; comparing, by the controller, the predicted efficiency and the calculated efficiency to determine an estimated value of the gas volume fraction of the fluid; and modulating, by the controller, at least one regulating device coupled to at least one flow control device based on the estimated value of the gas volume fraction of the fluid.

8. The method in accordance with claim 7 further comprising: receiving, from at least one sensing device the measured values of the differential pressure across said multiphase pump, the pump speed, and the temperature at said inlet pipe; determining a predicted efficiency of the multiphase pump based on the initial estimate of a gas volume fraction of the fluid at the inlet pipe and the received measured values of the differential pressure across the multiphase pump, the pump speed, and the temperature at the inlet pipe; comparing the predicted efficiency and the calculated efficiency to determine the estimated value of the gas volume fraction at the inlet pipe; and modulating the at least one regulating device based on the estimated value of the gas volume fraction of the fluid.

9. The method in accordance with claim 7, wherein modulating the at least one regulating device comprises modulating a recirculation valve in fluid communication with the outlet pipe of the multiphase pump and the inlet pipe of the multiphase pump such that the estimated value of the gas volume fraction at the inlet pipe reaches a set point value.

10. The method in accordance with claim 7, wherein receiving a measured value of the at least one operating characteristic of the multiphase pump comprises receiving the pump speed value of the multiphase pump and wherein modulating, by the controller, at least one regulating device coupled to at least one flow control device comprises:

comparing the received pump speed value and the estimated gas volume fraction value to a static system operating map including a correlation of a recirculation valve position with the values of pump speed and values of gas volume fraction at the inlet pipe of the multiphase pump, the static system operating map further including a set point plane defining a valve position of the recirculation valve based on the pump speed and the gas volume fraction, and modulating a recirculation valve in fluid communication with the outlet pipe of the multiphase pump and the inlet pipe of the multiphase pump based on the static system operating map and the set point plane.

11. The method in accordance with claim 7, wherein said pump map includes a correlation of volume flow across the multiphase pump, pressure differential, and the gas volume fraction of the fluid, the pump map further indicating operating points where a flow surge may occur in the fluid transport system, the method further comprising:

determining, based at least on the estimated value of the gas volume fraction of the fluid, if an operating point of the multiphase pump is within a surge margin, and if the operating point is within the surge margin, modulating the at least one regulating device such that a recirculation valve is moved to a position that inhibits flow surge.

12. A submersible resource recovery system for controlling a fluid transport system and flow of a fluid transported by a multiphase pump, said submersible resource recovery system comprising: a submerged wellhead; a top-side production location; at least one flow control device; a multiphase pump comprising an inlet pipe and an outlet pipe, wherein the multiphase pump is configured to transport the fluid from said submerged wellhead to said topside production location, said multiphase pump further configured to be submersible; at least one sensing device configured to measure a value of at least one operating characteristic of said multiphase pump or said fluid; at least one regulating device coupled to said at least one flow control device; and a controller coupled to said at least one pump sensing device and said at least one regulating device, said controller programmed with a pump map comprising a correlation of the at least one operating characteristic with a gas volume fraction of the fluid, wherein the at least one operating characteristic comprises a differential pressure across said multiphase pump, a pump speed, and a temperature at said inlet pipe, wherein said controller is configured to: receive from said at least one sensing device a measured value of the at least one operating characteristic; determine a predicted efficiency of said multiphase pump based on the received measured value of the at least one operating characteristic and an initial estimate of a gas volume fraction of the fluid at the inlet pipe; determine a calculated efficiency of said multiphase pump based on a measured value of a power consumption of said multiphase pump; compare the predicted efficiency and the calculated efficiency to determine an estimated value of the gas volume fraction of the fluid; and modulate said at least one regulating device based on the estimated value of the gas volume fraction of the fluid.

13. The system in accordance with claim 12, wherein said controller is configured to: receive from said at least one sensing device measured values of the differential pressure across said multiphase pump, the pump speed, and the temperature at said inlet pipe; determine a predicted efficiency of said multiphase pump based on the initial estimate of a gas volume fraction of the fluid at the inlet pipe and the received measured values of the differential pressure across said multiphase pump, the pump speed, and the temperature at said inlet pipe; compare the predicted efficiency and the calculated efficiency to determine the estimated value of the gas volume fraction at said inlet pipe; and modulate said at least one regulating device based on the estimated value of the gas volume fraction of the fluid.

14. The system in accordance with claim 12 further comprising a recirculation valve coupled to said at least one regulating device, said recirculation valve in fluid communication with said outlet pipe, said recirculation valve in further fluid communication with said inlet pipe, wherein said controller is further configured to modulate said at least one regulating device to open and close said recirculation valve to induce the estimated value of the gas volume fraction at said inlet pipe to reach a set point value.

15. The system in accordance with claim 12, wherein said at least one flow control device comprises a recirculation valve in fluid communication with said outlet pipe, said recirculation valve in further fluid communication with said inlet pipe, said controller is further programmed with a static system operating map including a correlation of a valve position of said recirculation valve with the pump speed of said multiphase pump and the gas volume fraction at said inlet pipe, said static system operating map further including a set point plane defining a valve position of said recirculation valve based on the pump speed and the gas volume fraction, and said controller is further configured to modulate said at least one regulating device to operate said recirculation valve based on said static system operating map and said set point plane.

* * * * *